US006892700B2

(12) United States Patent
Suzuki et al.

(10) Patent No.: US 6,892,700 B2
(45) Date of Patent: May 17, 2005

(54) ENGINE CONTROL SYSTEM FOR AN OUTBOARD MOTOR

(75) Inventors: Masaru Suzuki, Shizuoka (JP); Sadato Yoshida, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 36 days.

(21) Appl. No.: 10/141,534

(22) Filed: May 7, 2002

(65) Prior Publication Data

US 2002/0174853 A1 Nov. 28, 2002

Related U.S. Application Data

(60) Provisional application No. 60/322,191, filed on Sep. 13, 2001.

(30) Foreign Application Priority Data

May 7, 2001 (JP) ..... 2001-136545

(51) Int. Cl.[7] ..... F02M 3/00

(52) U.S. Cl. ..... 123/339.23; 123/491; 123/406.53

(58) Field of Search ..... 123/366, 339.23, 123/339.22, 339.11, 406.53, 406.55, 491, 345; 701/113

(56) References Cited

U.S. PATENT DOCUMENTS 3,923,031 A * 12/1975 Keranen ..... 123/179.17
4,079,708 A * 3/1978 Wieland et al. ..... 123/376
4,114,570 A * 9/1978 Marchak et al. ..... 123/491
4,224,913 A * 9/1980 Barnard ..... 123/686
4,454,847 A * 6/1984 Isomura et al. ..... 123/492
4,621,602 A * 11/1986 Furuyama ..... 123/406.16
5,060,617 A 10/1991 Kojima et al. ..... 123/435
5,215,068 A 6/1993 Kato ..... 123/676
5,309,882 A * 5/1994 Hoshiba et al. ..... 123/339.11
5,345,910 A * 9/1994 Remmers et al. ..... 123/406.53
5,465,701 A 11/1995 Hunt ..... 123/531
5,615,661 A 4/1997 Suzuki ..... 123/688
5,778,857 A 7/1998 Nakamura et al. ..... 123/425
6,032,632 A * 3/2000 Bolenz et al. ..... 123/179.3
6,039,012 A * 3/2000 Motoyama ..... 123/65 PE
6,098,605 A * 8/2000 Brooks ..... 123/680
6,109,235 A * 8/2000 Hoshiba et al. ..... 123/339.11
6,334,417 B1 1/2002 Salber et al. ..... 123/179.1
6,354,282 B1 * 3/2002 Yoshii et al. ..... 123/564
6,371,094 B1 4/2002 Wagner ..... 123/576
6,397,818 B1 * 6/2002 Price et al. ..... 123/406.55
6,588,402 B2 * 7/2003 Price et al. ..... 123/406.55
6,598,589 B2 * 7/2003 Frelund et al. ..... 123/435
6,637,386 B2 * 10/2003 Murata et al. ..... 123/90.15

FOREIGN PATENT DOCUMENTS

EP 1188914 * 3/2002 ..... F02D/1/06

* cited by examiner

*Primary Examiner*—Hai Huynh
(74) *Attorney, Agent, or Firm*—Knobbe, Martens, Olson & Bear, LLP

(57) ABSTRACT

An electronically controlled engine management system for an outboard motor, which determines the temperature of the engine and manipulates the engine management parameters to allow the engine to operate smoothly and efficiently. The engine temperature detection permits an efficient starting environment as well as an smooth starting to normal running transition period.

24 Claims, 7 Drawing Sheets

Retard
Ignition Timing
Advance
120
122
124

Fuel Injection Amount
126
130
0
128

132
ISC Opening
134
Initial opening 138
700 (Idle)
136
Engine Speed in RPM
500
0
Time (seconds)
Power (Igntion) On
Starting period
Engine running

ENGINE CONTROL SYSTEM FOR AN OUTBOARD MOTOR

PRIORITY INFORMATION

This application is based on and claims priority to Japanese Patent Application No. 2001-136545, filed May 7, 2001 and to the Provisional Application No. 60/322191, filed Sep. 13, 2001, the entire contents of which is hereby expressly incorporated by reference.

FIELD OF THE INVENTION

The present invention relates generally to an engine control system for an outboard motor, and more particularly to an improved engine management systems for better controlling both warm and cold starting and running conditions.

DESCRIPTION OF THE RELATED ART

Watercraft engines typically incorporate an engine management system. Watercraft engines are started and operate in warm and cold environments and are expected to perform well in all conditions. Under such various environments the mixture to be combusted within the engine may be effected, for example when starting the engine while it is warm.

When an engine is shut off after running at its correct operating temperature and then started again, it is characterized as a hot start. During such hot starts the mixture tends to be rich because the fuel vapors tend to accumulate and are delivered to the engine induction system upon starting. A warm starting engine may start and perform poorly due to this rich mixture. Along with poor running conditions an unnecessary increase in fuel consumption is caused when the mixture is too rich.

Engines are often started in cold environments where a richer mixture is needed to compensate for the losses resulting from condensation on the cylinder walls and in order to facilitate starting the cold engine. Without this richer mixture the engine may start and perform poorly.

SUMMARY OF THE INVENTION

One aspect of the present invention is to accurately monitor engine parameters and adjust various components to allow the engine to start and run correctly in all environments. Various components that can be adjusted in order to enhance engine starting and running performance may include the fuel injection, ignition, and allowing additional air to bypass the throttle valve.

Constant monitoring of various engine parameters is performed to control engine-running variables to allow the engine to start and run correctly and efficiently under all temperature conditions. The engine control system monitors the engine temperature and the mixture is adjusted for all engine operational environments in order to provide the operator with a correct running engine. Such an advanced engine control system allows for a high performing engine life.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise seven figures in which.

DETAILED DESCRIPTION OF THE PREFERRED EMBODIMENT

The Overall Construction

Figure 1:
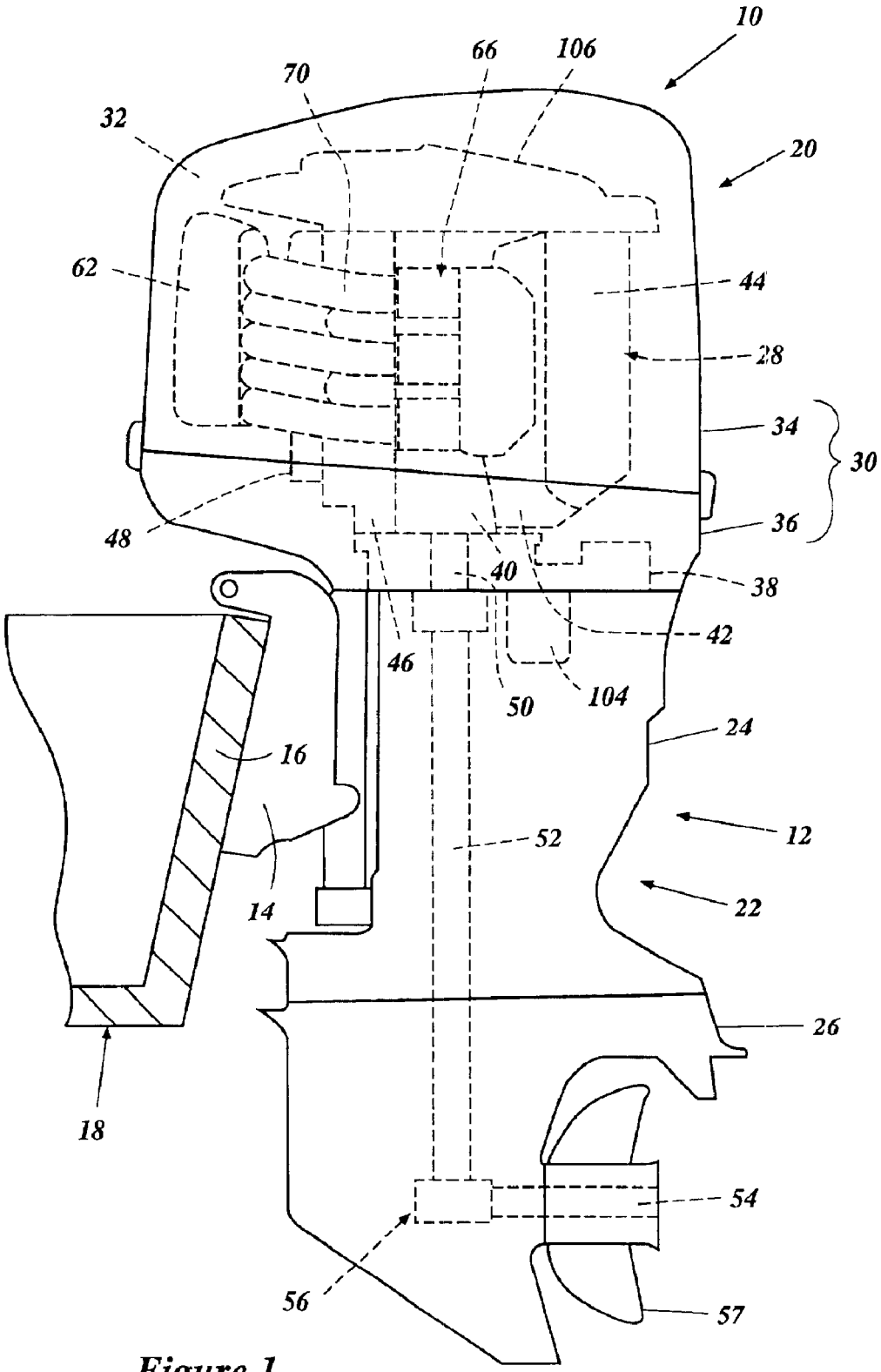
FIG. 1 is a side elevational view of an outboard motor configured in accordance with a preferred embodiment of the present invention, with an associated watercraft partially shown in section.

With reference to FIGS. 1–5, an outboard motor 10 includes a drive unit 12 and a bracket assembly 14. The bracket assembly 14 attaches the drive unit 12 to a transom 16 of an associated watercraft 18 and supports a marine propulsion device such as propeller 57 in a submerged position relative to a surface of a body of water.

As used to this description, the terms "forward," "forwardly," and "front" mean at or to the side where the bracket assembly 14 is located, unless indicated otherwise or otherwise readily apparent from the context use. The terms "rear," "reverse," "backwardly," and "rearwardly" mean at or to the opposite side of the front side.

The illustrated drive unit 12 includes a power head 20 and the housing unit 22. Unit 22 includes a drive shaft housing 24 and the lower unit 26. The power head 20 is disposed atop the housing unit 22 and includes an internal combustion engine 28 within a protective cowling assembly 30, which advantageously is made of plastic. The protective cowling assembly 30 typically defines a generally closed cavity 32 in which the engine 28 is disposed. The engine 28 is thereby is generally protected by the cowling assembly 30 from environmental elements.

The protective cowling assembly 30 includes a top cowling member 34 and a bottom cowling member 36. The top cowling member 34 is advantageously detachably affixed to the bottom cowling member 36 by a suitable coupling mechanism to facilitate access to the engine and other related components.

The top cowling member 34 includes a rear intake opening (not shown) defined from an upper end portion. This rear intake member with one or more air ducts can, for example, be formed with, or affixed to, the top cowling member 34. The rear intake member, together with the upper rear portion of the top cowling member 34, generally defines a rear air intake space. Ambient air is drawn into the closed cavity 32 near the rear intake opening and the air ducts of the rear intake member. Typically, the top cowling member 34 tapers in girth toward its top surface, which is in the general proximity of the air intake opening. This taper reduces the lateral dimension of the outboard motor, which helps to reduce the air drag on the watercraft 18 during movement.

The bottom cowling member 36 has an opening for which an upper portion of an exhaust guide member 38 extends. The exhaust guide member 38 advantageously is made of aluminum alloy and is affixed to the top of the driveshaft housing 24. The bottom cowling member 36 and the exhaust guide member 38 together generally form a tray. The engine 28 is placed on to this tray and can be connected to the exhaust guide member 38. The exhaust guide member 38 also defines an exhaust discharge passage through which burnt charges (e.g., exhaust gases) from the engine 28 pass.

Figure 2:
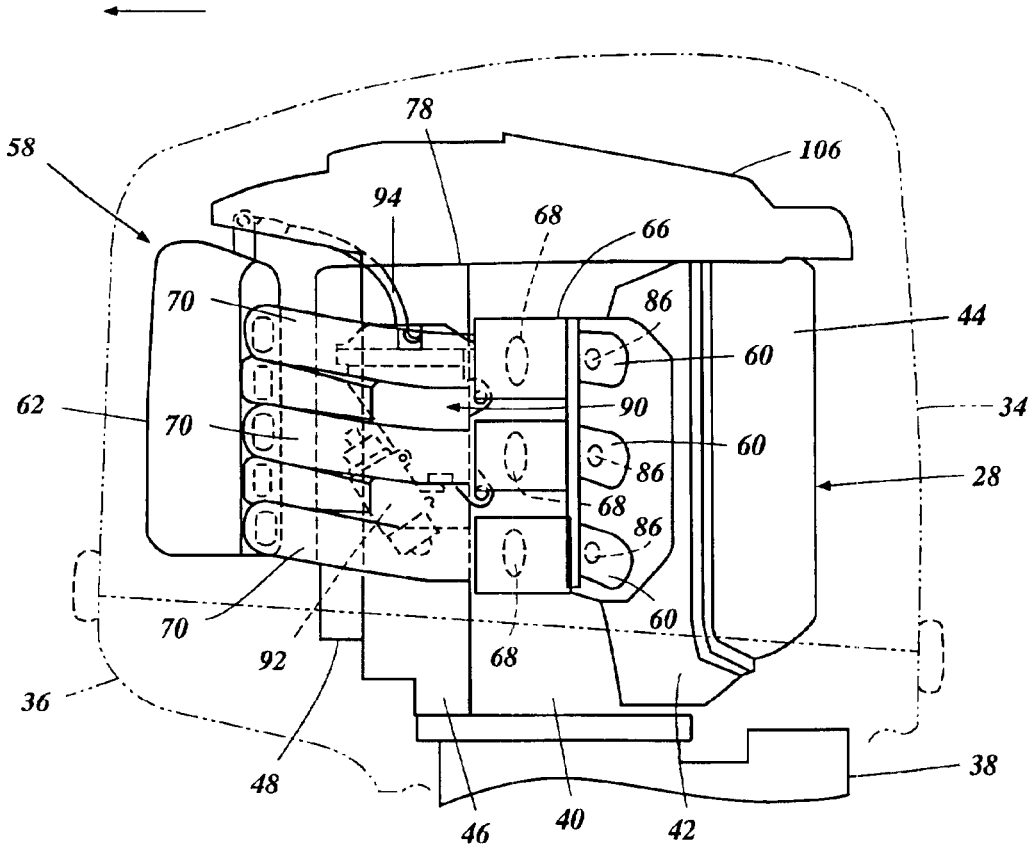
FIG. 2 is a side elevational view of an upper section of an outboard motor configured in accordance with a preferred embodiment of the present invention, with various parts shown in phantom.
Figure 3:
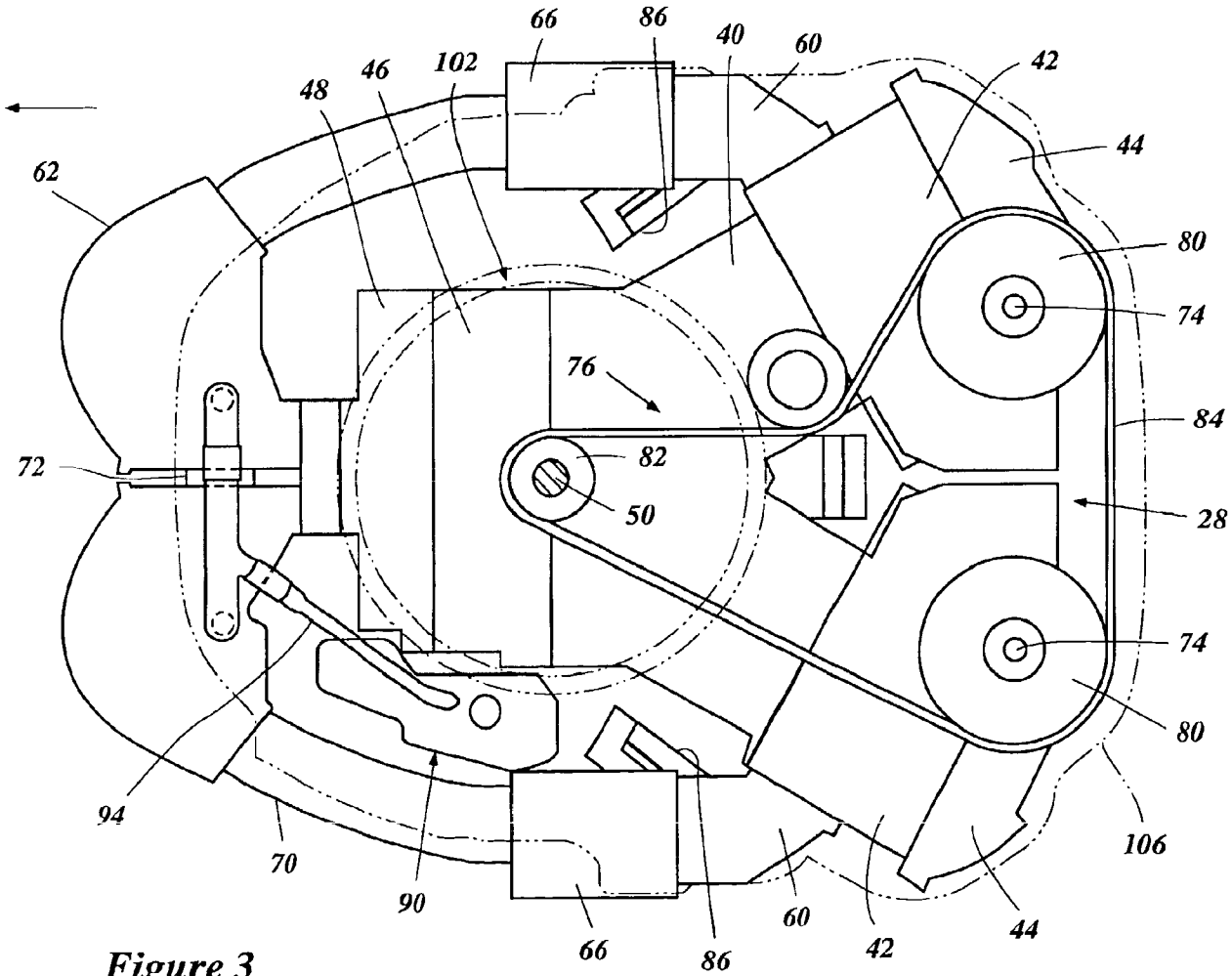
FIG. 3 is a top view of an outboard motor configured in accordance with a preferred embodiment of the present invention, with various parts shown in phantom.

The engine 28 in the illustrated embodiment preferably operates on a four-cycle combustion principle. With reference now to FIGS. 2 and 3, the engine embodiment illustrated is a DOHC six-cylinder engine having a V-shaped cylinder block 40. The cylinder block 40 thus defines two cylinder banks, which extend generally side by side with each other. In the illustrated arrangement, each cylinder bank has three cylinder bores such that the cylinder block 40 has six cylinder bores in total. The cylinder bores of each bank extend generally horizontally and are generally vertically spaced from one another. This type of engine, however, merely exemplifies one type of engine. Engines having other numbers of cylinders, having other cylinder arrangements (in line, opposing, etc.), and operating on other combustion principles (e.g., crankcase compression, two-stroke or rotary) can be used in other embodiments.

As used in this description, the term "horizontally" means that members or components extend generally and parallel to the water surface (i.e., generally normal to the direction of gravity) when the associated watercraft 18 is substantially stationary with respect to the water surface and when the drive unit 12 is not tilted (i.e., as shown in FIG. 1). The term "vertically" in turn means that proportions, members or components extend generally normal to those that extend horizontally.

A movable member, such as a reciprocating piston, moves relative to the cylinder block 40 in a suitable manner. In the illustrated arrangement, a piston (not shown) reciprocates within each cylinder bore. Because the cylinder block 40 is split into the two cylinder banks, each cylinder bank extends outward at an angle to an independent first end in the illustrated arrangement. A pair of cylinder head members 42 are fixed to the respective first ends of the cylinder banks to close those ends of the cylinder bores. The cylinder head members 42 together with the associated pistons and cylinder bores provide six combustion chambers (not shown). Of course, the number of combustion chambers can vary, as indicated above. Each of the cylinder head member 42 is covered with the cylinder head cover member 44.

A crankcase member 46 is coupled with the cylinder block 40 and a crankcase cover member 48 is further coupled with a crankcase member 46. The crankcase member 46 and a crankcase cover member 48 close the other end of the cylinder bores and, together with the cylinder block 40, define the crankcase chamber. Crankshaft 50 extends generally vertically through the crankcase chamber and journaled for rotation about a rotational axis by several bearing blocks. Connecting rods couple the crankshaft 50 with the respective pistons in any suitable manner. Thus, a reciprocal movement of the pistons rotates the crankshaft 50.

With reference again to FIG. 1, the driveshaft housing 24 depends from the power head 20 to support a drive shaft 52, which is coupled with crankshaft 50 and which extends generally vertically through driveshaft housing 24. A driveshaft 52 is journaled for rotation and is driven by the crankshaft 50.

The lower unit 26 depends from the driveshaft housing 24 and supports a propulsion shaft 54 that is driven by the driveshaft 52 through a transmission unit 56. A propulsion device is attached to the propulsion shaft 54. In the illustrated arrangement, the propulsion device is the propeller 57 that is fixed to the transmission unit 56. The propulsion device, however, can take the form of a dual counter-rotating system, a hydrodynamic jet, or any of a number of other suitable propulsion devices.

Preferably, at least three major engine portions 40, 42, 44, 46, and 48 are made of aluminum alloy. In some arrangements, the cylinder head cover members 44 can be unitarily formed with the respective cylinder members 42. Also, the crankcase cover member 48 can be unitarily formed with the crankcase member 46.

The engine 28 also comprises an air intake system 58. The air intake system 58 draws air from within the cavity 32 to the combustion chambers. The air intake system 58 shown comprises six intake passages 60 and a pair of plenum chambers 62. In the illustrated arrangement, each cylinder bank communicates with three intake passages 60 and one plenum chamber 62.

The most downstream portions of the intake passages 60 are defined within the cylinder head member 42 as inner intake passages. The inner intake passages communicate with the combustion chambers through intake ports, which are formed at inner surfaces of the cylinder head members 42. Typically, each of the combustion chambers has one or more intake ports. Intake valves are slidably disposed at each cylinder head member 42 to move between an open position and a closed position. As such, the valves act to open and close the ports to control the flow of air into the combustion chamber. Biasing members, such as springs, are used to urge the intake valves toward their respective closed positions by acting between a mounting boss formed on each cylinder head member 42 and a corresponding retainer that is affixed to each of the valves. When each intake valve is in the open position, the inner intake passage thus associated with the intake port communicates with the associated combustion chamber.

Other portions of the intake passages 60, which are disposed outside of the cylinder head members 42, preferably are defined with intake conduits 64. In the illustrated arrangement, each intake conduit 64 is formed with two pieces. One piece is a throttle body 66, in which a throttle valve assembly 68 is positioned. Throttle valve assemblies 68 are schematically illustrated in FIG. 2. The throttle bodies 66 are connected to the inner intake passages. Another piece is an intake runner 70 disposed upstream of the throttle body 66. The respective intake conduit 64 extend forwardly alongside surfaces of the engine 28 on both the port side and the starboard side from the respective cylinder head members 42 to the front of the crankcase cover member 48. The intake conduits 64 on the same side extend generally and parallel to each other and are vertically spaced apart from one another.

Each throttle valve assembly 68 preferably includes a throttle valve. Preferably, the throttle valves are butterfly valves that have valve shafts journaled for pivotal movement about generally vertical axis. In some arrangements, the valve shafts are linked together and are connected to a control linkage. The control linkage is connected to an operational member, such as a throttle lever, that is provided on the watercraft or otherwise proximate the operator of the watercraft 18. The operator can control the opening degree of the throttle valves in accordance with operator request through the control linkage. That is, the throttle valve assembly 68 can measure or regulate amounts of air that flow through intake passages 60 through the combustion chambers in response to the operation of the operational member by the operator. Normally, the greater the opening degree, the higher the rate of air flow and the higher the engine speed. An idle speed control (ISC) valve 71 bypasses the throttle body 66 and allows for the regulation of air to the engine in order to govern the engine idle speed.

The respective plenum chambers 62 are connected with each other through one or more connecting pipes 72 (FIG. 3) to substantially equalize the internal pressures within each chamber 62. The plenum chambers 62 coordinate or smooth air delivered to each intake passage 60 and also act as silencers to reduce intake noise.

The air within the closed cavity 32 is drawn into the plenum chamber 62. The air expands within the plenum chamber 62 to reduce pulsations and then enters the outer intake passages 60. The air passes through the outer intake passage 60 and flows into the inner intake passages. The throttle valve assembly 68 measures the level of airflow before the air enters into the inner intake passages.

The engine 28 further includes an exhaust system that routes burnt charges, i.e., exhaust gases, to a location outside of the outboard motor 10. Each cylinder head member 42 defines a set of inner exhaust passages that communicate with the combustion chambers to one or more exhaust ports which may be defined at the inner surfaces of the respective cylinder head members 42. The exhaust ports can be selectively opened and closed by exhaust valves. The construction of each exhaust valve and the arrangement of the exhaust valves are substantially the same as the intake valve and the arrangement thereof, respectively. Thus, further description of these components is deemed unnecessary.

Exhaust manifolds preferably are defined generally vertically with the cylinder block 40 between the cylinder bores of both the cylinder banks. The exhaust manifolds communicate with the combustion chambers through the inner exhaust passages and the exhaust ports to collect the exhaust gas therefrom. The exhaust manifolds are coupled with the exhaust discharge passage of the exhaust guide member 38. When the exhaust ports are opened, the combustion chambers communicate with the exhaust discharge passage through the exhaust manifolds. A valve cam mechanism preferably is provided for actuating the intake and exhaust valves in each cylinder bank. In the embodiment shown, the valve cam mechanism includes second rotatable members such as a pair of camshafts 74 per cylinder bank. The camshafts 74 typically comprise intake and exhaust camshafts that extend generally vertically and are journaled for rotation between the cylinder head members 42 and the cylinder head cover members 44. The camshafts 74 have cam lobes (not shown) to push valve lifters that are fixed to the respective ends of the intake and exhaust valves in any suitable manner. Cam lobes repeatedly push the valve lifters in a timely manner, which is in proportion to the engine speed. The movement of the lifters generally is timed by rotation of the camshaft 74 to appropriately actuate the intake and exhaust valves.

The camshaft drive mechanism 76 preferably is provided for driving the valve cam mechanism. The camshaft drive mechanism 76 in the illustrated arrangement is formed above a top surface 78 (see FIG. 2) of the engine 28 and includes driven sprockets 80 positioned atop at least one of each pair of camshafts 74, a drive sprocket 82 positioned atop the crankshaft 50 and the flexible transmitter, such as a timing belt or chain 84, for instance, wound around the driven sprockets 80 and the drive sprocket 82. The crankshaft 50 thus drives the respective crankshaft 74 through the time belt 84 in the timed relationship.

The illustrated engine 28 further includes indirect, port or intake passage fuel injection. In one arrangement, the engine 28 comprises fuel injection and, in another arrangement, the engine 28 is carburated. The illustrated fuel injection system shown includes six fuel injectors 86 with one fuel injector allotted to each one of the respective combustion chambers. The fuel injectors 86 preferably are mounted on the throttle body 66 of the respective banks.

Figure 4:
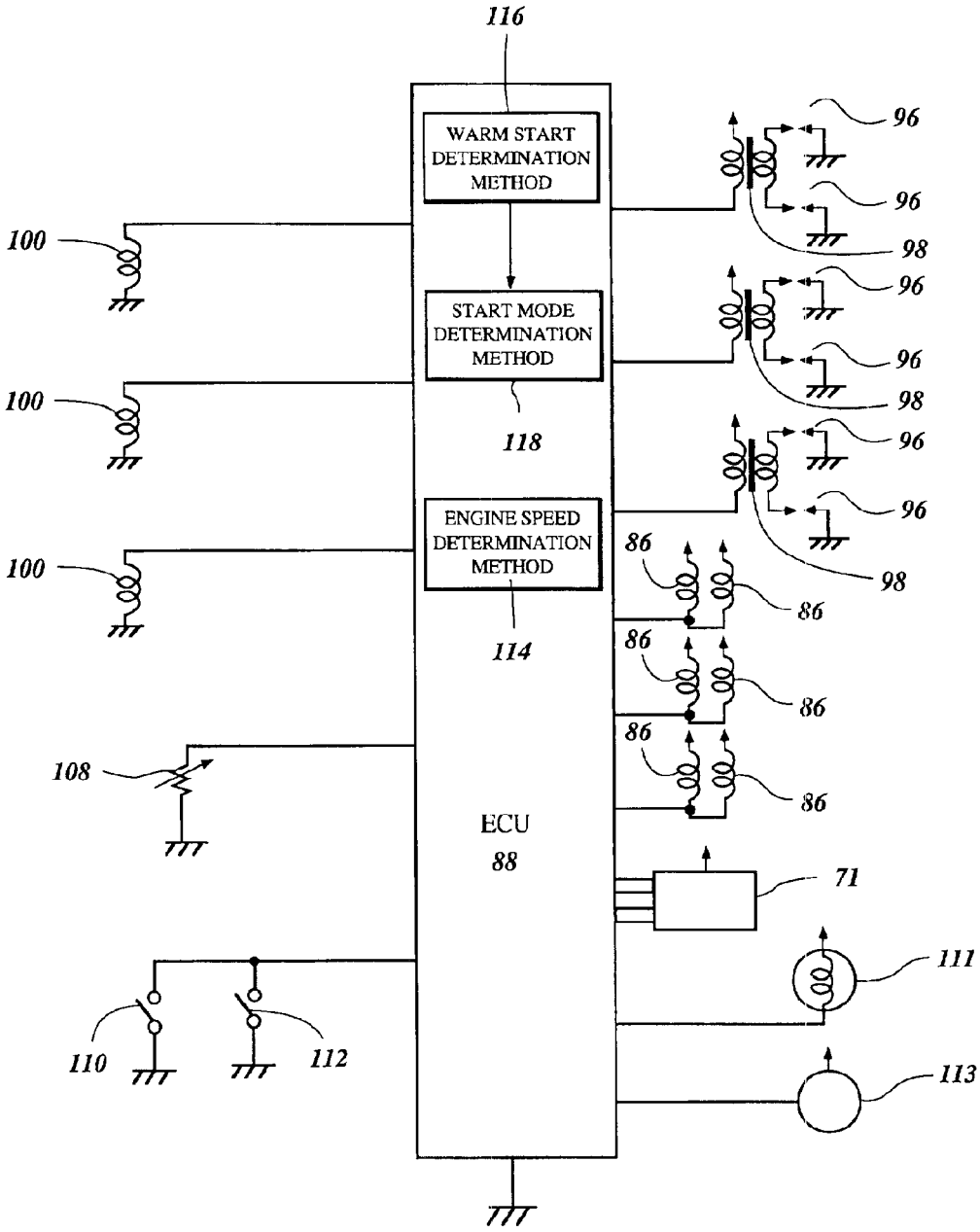
FIG. 4 is a schematic diagram of the electronic control unit and its control parameters.

Each fuel injector 86 has advantageously an injection nozzle directed downstream within the associated intake passage 60. The injection nozzle preferably is disposed downstream of the throttle valve assembly 60. The fuel injectors 86 spray fuel into the intake passages 60 under control of an electronic control unit (ECU) 88 (FIG. 4). The ECU 88 controls both the initiation, timing and the duration of the fuel injection cycle of the fuel injector 86 so that the nozzle spray a desired amount of fuel for each combustion cycle.

A vapor separator 90 preferably is in full communication with the tank and the fuel rails, and can be disposed along the conduits in one arrangement. The vapor separator 90 separates vapor from the fuel and can be mounted on the engine 28 at the side service of the port side.

The fuel injection system preferably employs at least two fuel pumps to deliver the fuel to the vapor separator 90 and to send out the fuel therefrom. More specifically, in the illustrated arrangement, a lower pressure pump 92, which is affixed to the vapor separator 90, pressurizes the fuel toward the vapor separator 90 and the high pressure pump (not shown), which is disposed within the vapor separator 90, pressurizes the fuel passing out of the fuel separator 90.

A vapor delivery conduit 94 couples the vapor separator 90 with at least one of the plenum chambers 62. The vapor removed from the fuel supply by the vapor separator 90 thus can be delivered to the plenum chambers 62 for delivery to the combustion chambers with the combustion air. In other applications, the engine 28 can be provided with a ventilation system arranged to send lubricant vapor to the plenum chamber(s). In such applications, the fuel vapor also can be sent to the plenum chambers via the ventilation system.

The engine 28 further includes an ignition system. Each combustion chamber is provided with a spark plug 96 (see FIG. 4), advantageously disposed between the intake and exhaust valves. Each spark plug 96 has electrodes that are exposed in the associated combustion chamber. The electrodes are spaced apart from each other by a small gap. The spark plugs 96 are connected to the ECU 88 through ignition coils 98. One or more ignition triggering sensors 100 are positioned around a flywheel assembly 102 to trigger the ignition coils, which in return trigger the spark plugs 96. The spark plugs 96 generate a spark between the electrodes to ignite an air/fuel charge in the combustion chamber according to desired ignition timing maps or other forms of controls.

Generally, during an intake stroke, air is drawn into the combustion chambers through the air intake passages 60 and fuel is mixed with the air by the fuel injectors 86. The mixed air/fuel charge is introduced to the combustion chambers. The mixture is then compressed during the compression stroke. Just prior to a power stroke, the respective spark plugs ignite the compressed air/fuel charge in the respective combustion chambers. The air/fuel charge thus rapidly burns during the power stroke to move the pistons. The burnt charge, i.e., exhaust gases, then is discharged from the combustion chambers during an exhaust stroke.

The illustrated engine further comprises a lubrication system to lubricate the moving parts within the engine 28. The lubrication system is a pressure fed system where the correct pressure is important to adequately lubricate the bearings and other rotating surfaces. The lubrication oil is delivered under pressure through an oil filter 104 and then dispersed throughout the engine to lubricate the internal moving parts.

The flywheel assembly 102, which is schematically illustrated with phantom line in FIG. 3, preferably is positioned atop the crankshaft 50 and is positioned for rotation with the crankshaft 50. The flywheel assembly 102 advantageously includes a flywheel magneto for AC generator that supplies electric power directly or indirectly via a battery to various electrical components such as the fuel injection system, the ignition system and the ECU 88. An engine cover 106 preferably extends over almost the entire engine 28, including the flywheel assembly 102.

In the embodiment of FIG. 1, the driveshaft housing 24 defines an internal section of the exhaust system that leaves the majority of the exhaust gases to the lower unit 26. The internal section includes an idle discharge portion that extends from a main portion of the internal section to discharge idle exhaust gases directly to the atmosphere through a discharge port that is formed on a rear surface of the driveshaft housing 24.

Lower unit 26 also defines an internal section of the exhaust system that is connected with the internal exhaust section of the driveshaft housing 24. At engine speeds above idle, the exhaust gases are generally discharged to the body of water surrounding the outboard motor 10 through the internal sections and then a discharge section defined within the hub of the propeller 57.

The engine 28 may include other systems, mechanisms, devices, accessories, and components other than those described above such as, for example, a cooling system. The crankshaft 50 through a flexible transmitter, such as timing belt 84 can directly or indirectly drive those systems, mechanisms, devices, accessories, and components.

The Engine Control System

Successful engine starting in various different environments is highly desirable and requires accurate response and adjustments of the controlling engine parameters. The present invention provides an engine control routine to accommodate successful engine starting regardless of a cold or warm engine.

During a warm engine start environment it is possible that fuel vapors from the vapor separator 90, caused by warm engine temperatures, collect in the plenum chambers 62 through the vapor delivery conduit 94. These collected fuel vapors provide a rich air/fuel mixture upon a warm engine starting period. The engine control routine of the present invention accommodates for such a richer than normal air/fuel mixture during starting.

As seen in FIG. 6, different graphs, 6*a*, 6*b*, 6*c*, 6*d* of various engine parameters are shown. Each graph represents an engine parameter before engine starting, during engine starting, and directly after engine starting all with reference to time.

Figure 5:
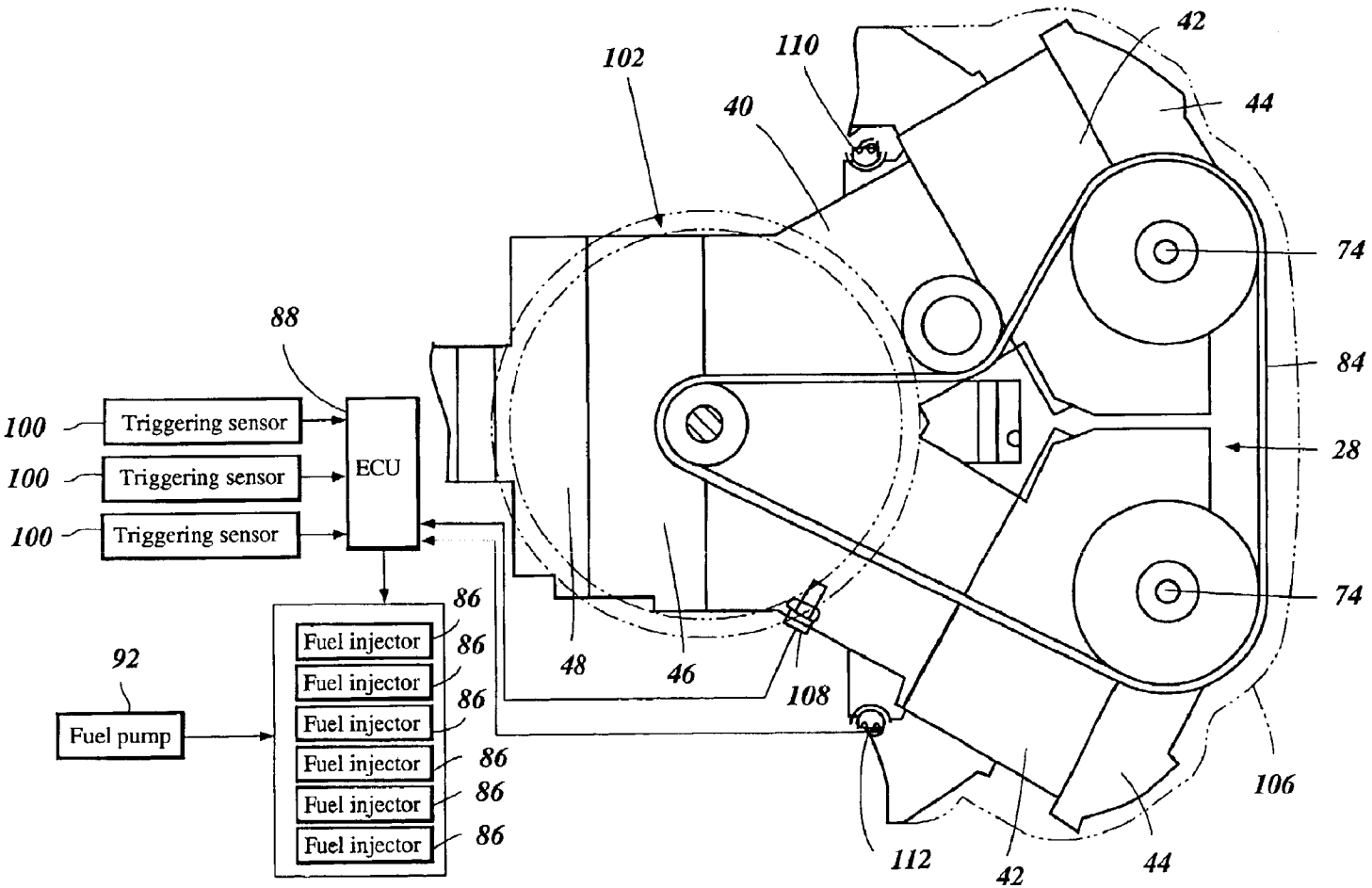
FIG. 5 is a top view of an outboard motor configured in accordance with a preferred embodiment of the present invention, with various electronically controlled parameters shown.

Referring to FIG. 5, in one embodiment, the engine control system incorporates an engine temperature sensor 108 located in the engine block 40 as well as cylinder head temperature sensors 110, 112 in each cylinder head member 42 to transmit to the ECU 88 signals corresponding to engine and individual cylinder head temperatures. An audible alarm 111 and a visual alarm 113 are activated when the cylinder head temperature sensors 110,112 or the engine temperature sensor detect an overheating temperature of the engine 28. When an overheating temperature of the engine 28 is detected, the ECU 88 initiates an engine overheat control whereby the engine speed is lowered be reducing the fuel injection amount or retarding the ignition timing.

As seen in FIG. 4, the ECU 88 is programmed to perform methods for accurately evaluating and adjusting parameters of the engine 28. Through the ignition triggering sensors 100 along with an engine speed determination method 114, the engine speed can be calculated. Other methods include a warm-start determination method 116 as well as a starting mode determination method 118.

Through the information acquired from the engine temperature sensors 108, 110, 112, and the combination of the methods 114, 116, 118, the ECU 88 accurately provides for a smooth, safe engine start and running condition.

Figures 6A, 6B, 6C, 6D:
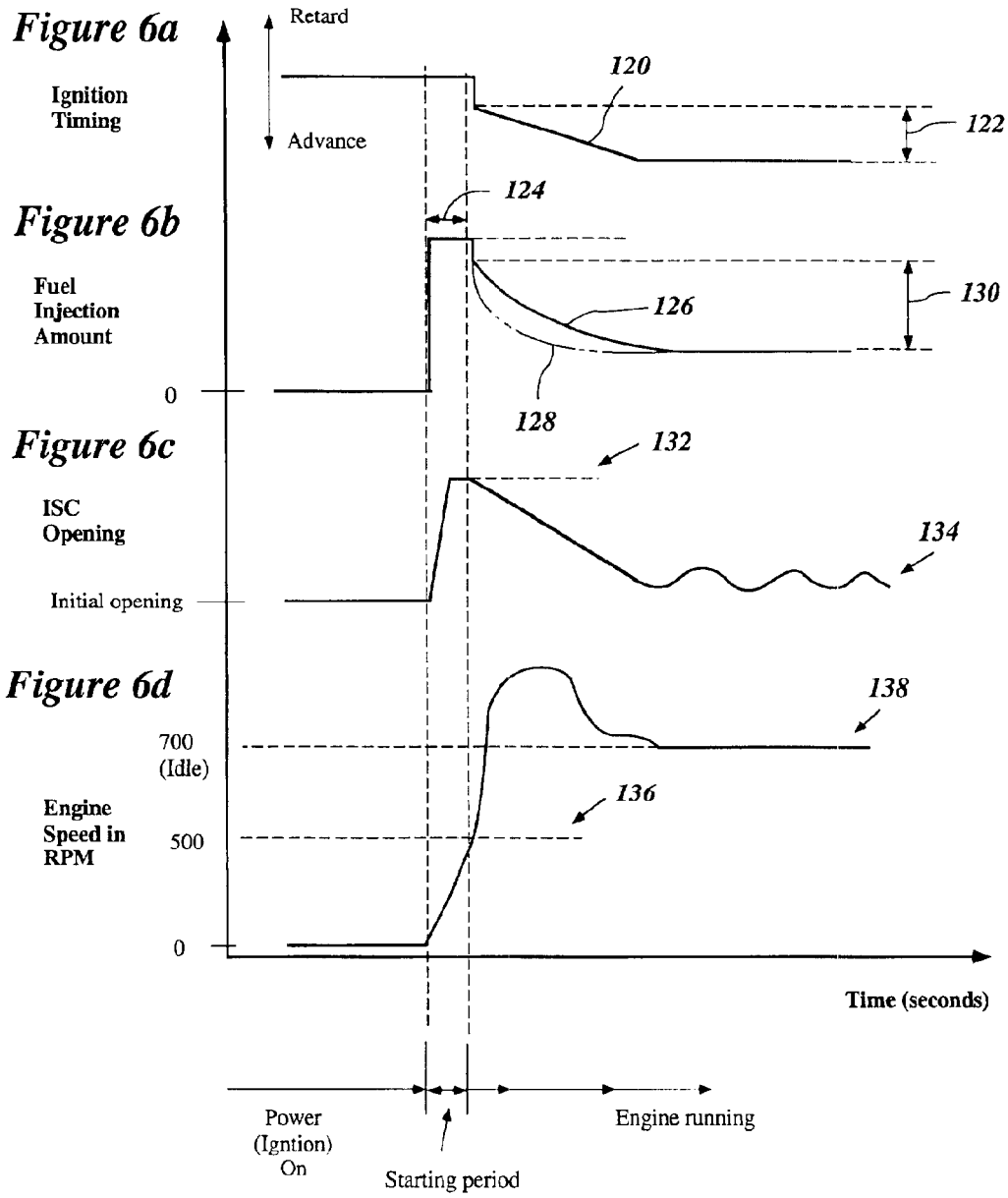
FIG. 6 is a graphical view showing engine parameters with reference to time.

FIG. 6*a* shows the ignition timing curve of the engine control system. Before and during engine starting the ignition timing is set at a retarded value to ease cranking and allow for a quick, easy engine start. After engine starting, the ignition value follows an advance curve 120 to raise the engine speed and improve engine responsiveness. The ignition advance value range 122 after engine starting and during an idle speed can also be seen.

FIG. 6*b* shows the amount of fuel injected during a period from before starting until an idle speed is reached. A time duration 124 represents how long fuel is injected at a specific amount while the engine is starting. This amount of fuel injected decreases as seen by the curves 126 and 128. The curve 126 represents a decrease in fuel injected after a cold engine start whereas the curve 128 represents a decrease in fuel injected after a warm engine start. A total fuel injection reduction range 130 can also be seen.

FIG. 6*c* represents the operation of the ISC valve 71. Initially, the ISC valve is opened during the starting period after the ignition power switch is turned on. After the starting period at a point 132, the ISC valve 71 begins to close and regulate the additional air allowed to the engine. When the engine speed has reached a predetermined idle speed, at point 134 the ISC valve continuously changes its opening to properly regulate the engine speed.

FIG. 6*d* represents the engine speed in revolutions per minute (RPM). As the engine speed rises, it reaches an engine start determination speed 136 where the ECU 88 determines that the engine 28 has reaches a speed, e.g. 500 RPM, that represents a successful engine start. The engine speed continues to rise and finally settles to a steady predetermined idle speed 138.

Figure 7:
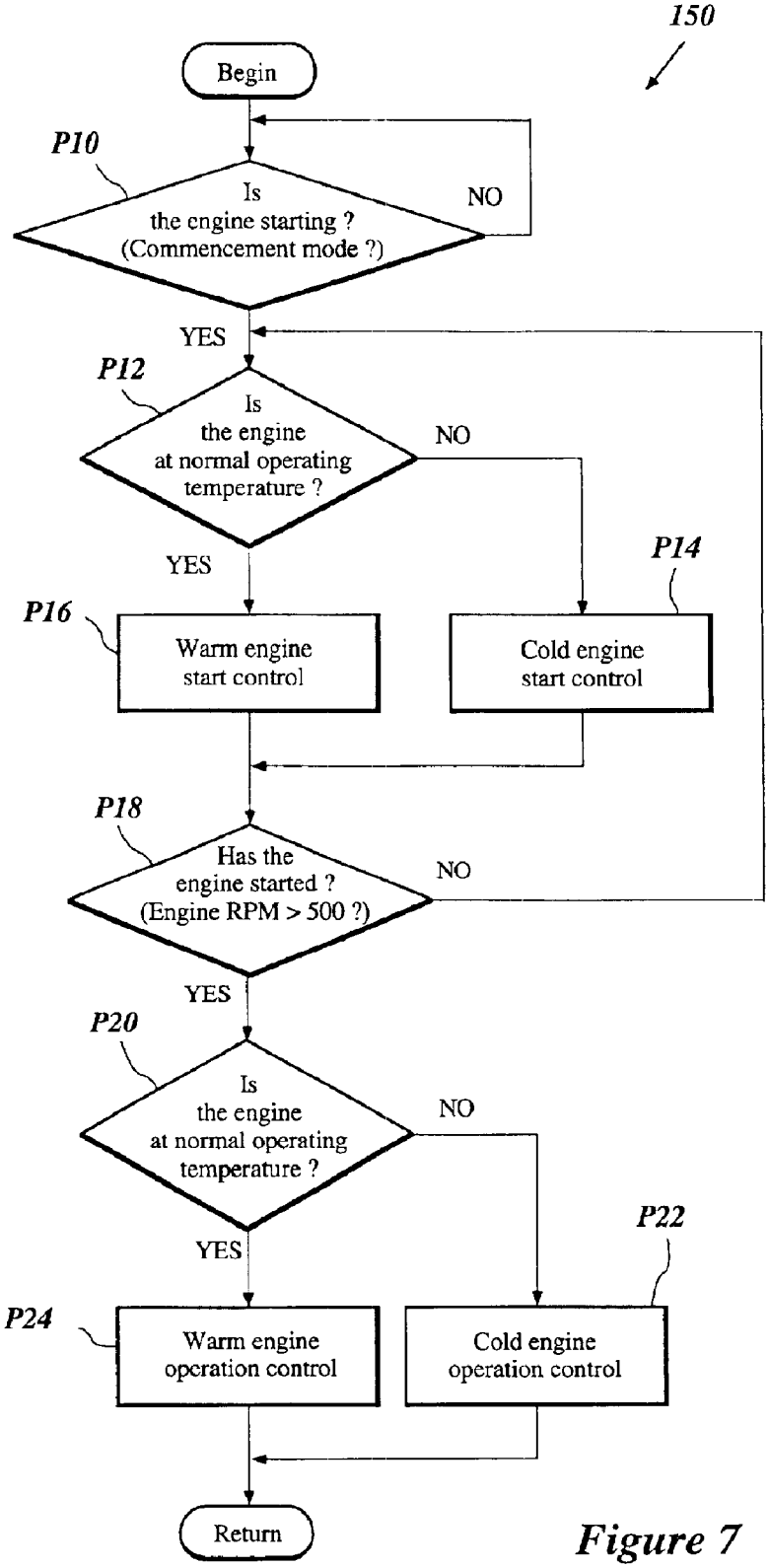
FIG. 7 is a flowchart representing a control routine arranged and configured in accordance with certain features, aspects, and advantages of the present invention.

FIG. 7 shows a control routine 150 implemented by ECU 88 arranged and configured in accordance with certain features, aspects, and advantages of the present invention. The control routine 150 begins and moves to a first decision block P10 in which it is determined if the engine is starting. The engine 28 is considered to be in the starting mode starting if the engine is revolving at a speed less than or equal to a predetermined value. By way of specific example, 500 RPM or less can define the starting mode. If the engine is not being started, the control routine 150 returns to the block P10. If it is determined that the engine is starting, the control routine 150 moves to decision block P12.

In decision block P12, it is determined if the engine is at a normal operating temperature. A normal operating temperature may be considered to be in the range of 80 degrees Celsius. If, in decision block P12 it is determined that the engine is not at a normal operating temperature, the control routine moves to operation block P14. If, however, in decision block P12 it is determined that the engine is at a normal operating temperature, the control routine moves to operation block P16.

In operation block P14, a cold engine start control is initiated. In such a cold engine start control, various aspects of engine management are initiated such as longer fuel injection duration. The control routine 150 then moves to decision block P18.

In operation block P16, a warm engine start control operation is initiated. In such a warm engine start control, various aspects of engine management are initiated such as shorter fuel injection duration as described above and shown in FIG. 6*b*. The control routine 150 then moves to decision block P18.

In decision block P18 it is determined if the engine has started. The engine is started if the engine rpm is above 500 rpm or greater. If in decision block P18 it is determined that the engine has not started, e.g., the engine rpm is less than 500 rpm, the control routine moves back to decision block P12. If, however, in decision block P18 it is determined that the engine has started, e.g., the engine rpm is above 500 rpm, the control routine then moves to decision block P20.

In decision block P20, it is determined if the engine is at a normal operating temperature. Normal operating temperature can be classified as a temperature in the range of 80 degrees Celsius. If, in decision block P20 it is determined that the engine is not at a normal operating temperature, the control routine moves to operation block P22. If, however, in decision block P20 it is determined that the engine is at a normal operating temperature, the control routine moves to operation block P24.

In operation block P22, a cold engine operation control procedure is initiated. Such a cold engine operation control involves compensating various engine control parameters in order to allow the engine to run smoothly at a decreased engine temperature.

In operation block P24, a warm engine operation control procedure is initiated. Such a warm engine operation control involves compensating various engine parameters in order to allow the engine to run successfully and smoothly at an increased engine temperature. The control routine 150 then returns.

It is to be noted that the control system described above may be in the form of a hard-wired feedback control circuit in some configurations. Alternatively, the control system may be constructed of a dedicated processor and memory for storing a computer program configured to perform the steps described above in the context of the flowchart. Additionally, the control systems may be constructed of a general-purpose computer having a general-purpose processor and memory for storing the computer program for performing the routine. Preferably, however, the control system are incorporated into the ECU 110, in any of the above-mentioned forms.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, some of the indicators sensed (e.g., engine speed and throttle position) to determine certain operating conditions (e.g., rapid deceleration) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. A marine engine control system for controlling both warm and cold starting and running conditions by simultaneously varying the ignition timing, fuel injection, and idle speed control valve, said control system comprising:

an engine temperature sensor;

an engine speed sensor;

a fuel injector;

an ignition system;

an idle speed control;

a programmed electronic control unit responsively coupled to said engine temperature sensor, said engine speed sensor operatively coupled to said fuel injector, said ignition system, and said idle speed control valve, said electronic control unit automatically providing a warm-start mode and a cold-start mode, said cold-start mode automatically controlling said fuel injectors to reduce the flow of fuel after starting along a first predetermined curve with time, and said warm-start mode automatically controlling said fuel injectors after starting along a second predetermined curve with time, said second curve having a greater rate of change after starting than said first curve, said cold-start mode automatically controlling said ignition system according to a predetermined ignition curve, said idle speed control valve being automatically controlled by maintaining the idle speed of said engine at a predetermined value.

2. The marine engine control system of claim 1, wherein the engine speed sensor can comprise one or more ignition triggering sensors.

3. A marine engine control system for controlling both warm and cold starting and running conditions by varying the fuel injection, said control system comprising:

an engine temperature sensor;

an engine speed sensor;

a fuel injector;

an ignition system;

an idle speed control;

a programmed electronic control unit responsively coupled to said engine temperature sensor, said engine speed sensor operatively coupled to said fuel injector, said ignition system, and said idle speed control valve, said electronic control unit automatically providing a warm-start mode and a cold-start mode, said cold-start mode automatically controlling said fuel injectors to reduce the flow of fuel after starting along a first predetermined curve with time, and said warm-start mode automatically controlling said fuel injectors after starting along a second predetermined curve with time, said second curve having a greater rate of change after starting than said first curve.

4. The marine engine control system of claim 3, wherein the engine speed sensor can comprise one or more ignition triggering sensors.

5. A marine engine control system for controlling both warm and cold starting and running conditions by varying the ignition timing, said control system comprising:

an engine temperature sensor;

an engine speed sensor;

a fuel injector;

an ignition system;

an idle speed control;

a programmed electronic control unit responsively coupled to said engine temperature sensor, said engine speed sensor operatively coupled to said fuel injector, said ignition system, and said idle speed control valve, said electronic control unit automatically providing a warm-start mode and a cold-start mode, said cold-start mode automatically controlling said ignition system according to a predetermined ignition curve.

6. The marine engine control system of claim 5, wherein the engine speed sensor can comprise one or more ignition triggering sensors.

7. A marine engine control system for controlling both warm and cold starting and running conditions by varying the idle speed control valve, said control system comprising:

an engine speed sensor;

an engine temperature sensor;

a fuel injector;

an ignition system;

an idle speed control;

a programmed electronic control unit responsively coupled to said engine speed sensor operatively coupled to said idle speed control valve, said electronic control unit automatically providing a warm-start mode and a cold-start mode, said idle speed control valve being automatically controlled by maintain the idle speed of said engine at a predetermined value.

8. The marine engine control system of claim 7, wherein the engine speed sensor can comprise one or more ignition triggering sensors.

9. The method of controlling both warm and cold starting of a marine engine comprising:

sensing the temperature of said engine;

automatically providing at the initiation of starting a cold start engine mode when a temperature below a predetermined value is detected and automatically providing a warm start engine mode when a temperature above a predetermined value is detected;

controlling the fuel injectors of said engine after starting along a first predetermined curve with time during said cold start engine mode;

controlling the fuel injectors of said engine after starting along a second predetermined curve with time during said warm start mode, said second curve having a greater rate of charge after starting than said first curve;

controlling the ignition system of said engine after starting according to a predetermined ignition curve;

sensing the speed of said engine; and automatically controlling an idle speed control valve to maintain the idle speed of said engine at a predetermined value.

10. The method of controlling both warm and cold starting of a marine engine comprising:

sensing the temperature of said engine;

automatically providing at the initiation of starting a cold start engine mode when a temperature below a predetermined value is detected and automatically providing a warm start engine mode when a temperature above a predetermined value is detected;

controlling the fuel injectors of said engine after starting along a first predetermined curve with time during said cold start engine mode; and controlling the fuel injectors of said engine after starting along a second predetermined curve with time during said warm start mode, said second curve having a greater rate of charge after starting than said first curve.

11. The method of controlling both warm and cold starting of a marine engine comprising:

sensing the temperature of said engine;

automatically providing at the initiation of starting a cold start engine mode when a temperature below a predetermined value is detected and automatically providing a warm start engine mode when a temperature above a predetermined value is detected;

controlling the ignition system of said engine after starting according to a predetermined ignition curve.

12. The method of controlling both warm and cold starting of a marine engine comprising:

sensing the temperature of said engine;

automatically providing at the initiation of starting a cold start engine mode when a temperature below a predetermined value is detected and a warm start engine mode when a temperature above a predetermined value is detected;

sensing the speed of said engine; and automatically controlling an idle speed control valve to maintain the idle speed of said engine at a predetermined value.

13. A marine engine control system comprising:

an engine temperature sensor arrangement for detecting a predetermined engine operating temperature, an ignition triggering sensor for detecting an engine speed, and an electronic control unit containing a warm engine start control, said electronic control unit responsively coupled to said engine temperature sensor arrangement and said ignition triggering sensor.

14. The marine engine control system of claim 13, wherein said temperature sensor arrangement includes one or more cylinder block temperature sensors.

15. The marine engine control system of claim 13, wherein said temperature arrangement includes one or more cylinder head temperature sensors.

16. The marine engine control system of claim 13, wherein said electronic control unit contains a warm engine operation control.

17. The marine engine control system of claim 13, wherein said engine temperature is sensed during an engine starting condition defined as an engine speed ranging from 0 to 500 revolution per minute.

18. The marine engine control system of claim 13, wherein said engine temperature is sensed during an engine commencement condition, said condition starting with initiation of starting the engine and terminating with said engine reaching a predetermined controlled idle speed.

19. The marine engine control system of claim 13, wherein an engine running condition can be defined as an engine speed greater than 500 revolutions per minute.

20. The marine engine control system of claim 13, wherein a normal engine operating temperature is reached at a temperature of 80 degrees Celsius.

21. The marine engine control system of claim 13, wherein the electronic control unit is configured so as to operate in a starting mode when the detected engine speed is below a predetermined engine speed.

22. The marine engine control system of claim 13, wherein the electronic control unit is configured so as not to operate in a starting mode when the detected engine speed is above a predetermined engine speed.

23. A marine engine control system comprising:

an engine temperature sensor arrangement for detecting a predetermined engine operating temperature, an ignition triggering sensor for detecting an engine speed, and an electronic control unit containing a cold engine start control, said electronic control unit responsively coupled to said engine temperature sensor arrangement and said ignition triggering sensor.

24. The marine engine control system of claim 23, wherein said electronic control unit contains a cold engine operation control.

* * * * *